US009144121B2

(12) United States Patent
Frias, Sr.

(10) Patent No.: US 9,144,121 B2
(45) Date of Patent: Sep. 22, 2015

(54) RECONFIGURABLE LED ARRAYS AND LIGHTING FIXTURES

(71) Applicant: Jacobo Frias, Sr., Bronx, NY (US)

(72) Inventor: Jacobo Frias, Sr., Bronx, NY (US)

( * ) Notice: Subject to any disclaimer, the term of this patent is extended or adjusted under 35 U.S.C. 154(b) by 74 days.

(21) Appl. No.: 13/682,330

(22) Filed: Nov. 20, 2012

(65) Prior Publication Data

US 2013/0127350 A1 May 23, 2013

Related U.S. Application Data

(60) Provisional application No. 61/561,914, filed on Nov. 20, 2011, provisional application No. 61/587,106, filed on Jan. 16, 2012.

(51) Int. Cl.
*H05B 37/00* (2006.01)
*H05B 33/08* (2006.01)

(52) U.S. Cl.
CPC ..... *H05B 33/0806* (2013.01)

(58) Field of Classification Search
CPC ..... H05B 33/0857; H05B 33/083; H05B 33/0827
USPC ..... 315/185 R, 186, 192, 210, 121, 320
See application file for complete search history.

(56) References Cited

U.S. PATENT DOCUMENTS

| | | | | |
|---|---|---|---|---|
| 5,138,310 | A | 8/1992 | Hirane et al. | |
| 5,399,940 | A | 3/1995 | Hanna et al. | |
| 5,959,413 | A * | 9/1999 | Komarek et al. | 315/306 |
| 7,221,044 | B2 | 5/2007 | Fan et al. | |
| 7,417,259 | B2 | 8/2008 | Sakai et al. | |
| 7,649,326 | B2 | 1/2010 | Johnson et al. | |
| 7,936,135 | B2 | 5/2011 | Hum et al. | |
| 8,106,599 | B2 * | 1/2012 | Radermacher et al. | 315/291 |
| 2011/0127922 | A1 * | 6/2011 | Sauerlaender | 315/192 |
| 2011/0133658 | A1 * | 6/2011 | Sauerlaender et al. | 315/192 |
| 2013/0134888 | A1 * | 5/2013 | Grajcar | 315/186 |

* cited by examiner

*Primary Examiner* — Don Le

(57) ABSTRACT

An optimum regulation method is disclosed for reconfigurable LED arrays used for general illumination applications. This document describes a reconfigurable LED array formed by connecting in series LED lamps and LED pairs capable of being reconfigured in either series or parallel. The performance deficiencies of previous solutions are solved by changing the knee voltage of the array through the reconfiguration of LED pairs. The simplicity of the concept can make practical the implementation of driverless LED lighting fixtures.

22 Claims, 3 Drawing Sheets

RECONFIGURABLE LED ARRAYS AND LIGHTING FIXTURES

CROSS REFERENCE TO RELATED APPLICATIONS

This application claims priority from, and incorporates by reference the entirety of, U.S. Provisional Patent Application Ser. No. 61/561,914, filed on Nov. 20, 2011, and Ser. No. 61/587,106, filed on Jan. 16, 2012.

FIELD

This invention relates to lighting devices used for general illumination purpose and constructed based on solid state devices such as Light Emitting Diodes better known as LED, which comprise LED arrays, electronic driving circuits, and reflectors enclosed in housing.

BACKGROUND OF THE INVENTION

The use of LED lamps is a trend that continues and as the technology matures, it is expected that LED lamps will be the predominant source of artificial light for general illumination purposes. LED lamps are robust solid state devices capable of lasting 50,000 hours or more. The main electrical components of existing LED fixtures are the LED module comprising LED lamps organized in arrays and an electronic driver. The driver is a complex device used to control the voltage and current applied to the LED arrays based on high frequency switching of power electronics devices. The buck and boost converters are typical topologies of existing LED drivers. Because of the complexity of these drivers, they are usually the weakest link in the LED lighting fixture system, limiting the expected life and output of the existing fixtures. Additional disadvantages of the existing LED drivers are, the over sizing of the LED lighting fixtures in order to house the relatively large driver units, lower energy efficiency, and higher cost of the LED lighting fixtures among others.

The prior art proposes to control the current of LED arrays by changing the configurations from series to parallel and vice versa. However, the solutions disclosed by the prior art are still not practical and of low commercial value. First, when the proposed regulation scheme maintains a constant current, some LED lamps are turned off making it not suitable for DC applications. On the other hand, when the solution scheme is to maintain a constant illumination level, the current of the array varies in a wide range generating higher amount of harmonics and increasing the design constrains of the driver.

There still is a market need for an LED lighting fixture with a minimum amount of electronic components to drive the LED arrays at lower switching frequencies and with improved current-illumination regulation and efficiency performances. Furthermore, in addition to increasing the efficiency and life expectancy at a lower cost, the electronic components can be integrated with the LED modules substantially decreasing the footprint of the LED fixtures.

SUMMARY OF THE INVENTION

An optimum current-illumination regulation scheme is proposed based on arrays formed by connecting in series LED lamps and LED pairs that can reconfigure their connections. The proposed inventive concept comprises regulating the current through an LED array by changing the array rated voltage as a consequence of reconfiguring the connections of the LED pairs, while substantially maintaining a constant illumination level. When the proposed inventive concept is applied to LED lighting fixtures, a simpler construction and a more reliable fixture is obtained thanks to the elimination of the high frequency drivers commonly used in existing LED lighting fixtures. In addition to the latter advantages, the proposed LED fixture has a smaller housing, higher energy efficiency, and lower cost. Furthermore, the simplicity of the concept makes it practical for integrating the control functions with the LED lamps allowing for the construction of driverless solid state lighting fixtures.

DETAILED DESCRIPTION OF THE INVENTION

The disadvantages of reconfigurable LED arrays proposed by the prior art are mitigated by only reconfiguring LED-pairs within the array. As later explained on this document, instead of being turned off, the LED-pairs are always on for filtered DC voltage applications, while maintaining a substantially constant current flow through the array.

The variations of the LED parameters with temperature will not be considered. This assumption can be acceptable for arrays having a higher number of LEDs as opposed to a single or small number of high power LED concentrated in a small area.

Figure 1:
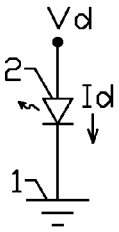
FIG. 1 depicts a graphical representation of an LED lamp.
Figure 2:
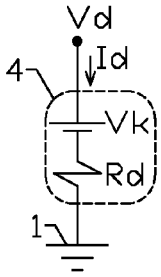
FIG. 2 illustrates the electrical model of the LED lamp shown in FIG. 1.
Figure 5:
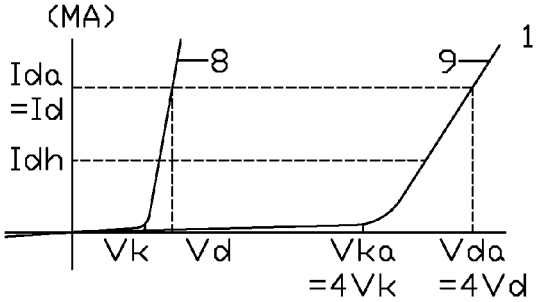
FIG. 5 represents a composite current-voltage plot of the curves corresponding to the LED lamp shown in FIG. 1 and the array shown in FIG. 3.

FIG. 1 shows the standard symbol used for LEDs. The negative terminal of the applied voltage Vd is connected to the ground terminal 1. The equivalent electrical circuit 4 of an LED 2 is illustrated in FIG. 2. Curve 8 shown in FIG. 5 is a typical plot of the forward current Id versus the voltage Vd of the LED 2. The battery models the LED 2 knee voltage Vk and is considered not to be influenced by the LED forward current Id. Curve 8 indicates that when the applied voltage Vd is lower than the knee voltage Vk, no substantial current flows through the LED 2. The forward voltage Vd in LED 2 is the sum of the knee voltage Vk plus the increment voltage ΔVRd, which is the voltage drop across Rd due to the flow of the forward current Id. At rated forward current Idr, the rated voltage across the LED 1 is Vdr=Vk+ΔVRdr=Vk+Idr*Rd. The high sensitivity of LEDs due to variations in the applied voltage is indicated by the steep slope of the curve 8 and it can be estimated as 1/Rd, approximately.

Figure 3:
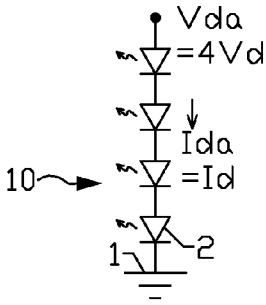
FIG. 3 illustrates an array formed with four LED lamps.
Figure 4:
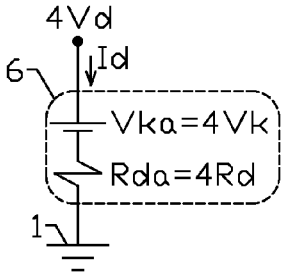
FIG. 4 shows the equivalent circuit of the LED array shown in FIG. 3.

FIG. 3 shows an array 10 of four LEDs 2 and FIG. 4 depicts its equivalent electrical circuit 6. The array 10 knee voltage Vka and the forward resistance Rda are now four times larger than the one shown for a single LED 2 in FIG. 2. Curve 9 shown in FIG. 5 is a plot of the array current Ida versus the array total voltage Vda. No substantial current Ida can flow through the LED array 10 if the applied voltage Vda is less than four times the knee voltage Vk of the individuals LEDs 2, that is, if Vda<4Vk. The array forward resistance Rda is approximately four times the forward resistance Rd of a single LED, and the slope shown in curve 9 is now smaller by a factor of four, that is, 1/Rda=1/(4Rd). In other words, the higher the number of LEDs 2 within the array, the less sensitive the array becomes to changes in the applied voltage Vda. As the number of LEDs 2 increases within the array, it becomes easier to control the current Ida. This is a fact that had not been exploited to its full potential. Because of the limitations of the high frequency drivers at higher voltages, the tendency of the present technology is to decrease the number of LEDs 2 within the array by increasing the power and voltage of a single LED 2. Two major disadvantages of this tendency are increase heat management issues due to higher power densities in a single area of the LED device and a worse light distribution due to a single point light source.

Figure 6:
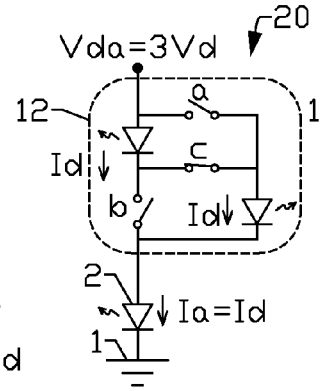
FIG. 6 illustrates an array with an LED-pair in series state.
Figure 7:
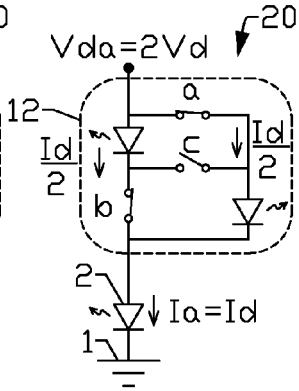
FIG. 7 illustrates an array with an LED-pair in parallel state.

FIG. 6 and FIG. 7 illustrate the inventive concept through a simple application of an LED array 20 consisting of a standard LED 2 and an LED-pair 12 connected in series. FIG. 6 shows the LED-pair 12 in series state. The LED-pair 12 is in series state when switch 'c' is closed and switches 'a' and 'b' are open, making the voltage of the LED-pair equal to 2Vd. When the LED-pair 12 is in series state, the voltage of the array 20 is equal to 3Vd. The current flowing through each LED of the pair 12 in series state is equal to the array current Ida. Notice that the current of the array Ida is equal to the current Id of the LED 2 located at the bottom. FIG. 7 shows the LED-pair 12 in parallel state. The LED-pair 12 is in parallel state when switch 'c' is open and switches 'a' and 'b' are closed, making the voltage of the LED-pair equal to Vd. When the LED-pair 12 is in parallel state, the voltage of the array 20 is equal to 2Vd. The current flowing through each LED of the pair 12 is now equal to approximately 50% of the array current Ida. The regulation of the current, voltage, and illumination levels of the array 20 shown in FIG. 6 and FIG. 7 is poor, which can fluctuate up to 40% of its expected value.

As the number of LEDs 2 increases within the array 20, the regulation performance improves dramatically. The LED-pair 12 represents the optimum regulation scheme for reconfigurable LED arrays. When changing the state of an LED-pair 12 the voltage rating Vda of the array changes by the minimum amount of ±Vd, and the array current Ida is kept substantially constant. While the illumination level of an LED-pair 12 changes by 50% approximately, the illumination level of the array is barely noticeable. If the DC voltage applied to the LED array contains 60 Hz ripples, the reconfiguration of the LED-pairs 12 occurs at a rate of 120 times per second, which can not be perceived by the human eye. There are additional advantages for using low frequency drivers in terms of lower design complexity and noise generation, higher efficiencies, and lower production cost.

The proposed inventive concept can be extended to have three LEDs 2 configured in an LED-triple module (not shown). The LED-triple can be capable of reconfiguring its three LEDs 2 in series, parallel, or a combination of a series-parallel connections; changing the voltage rating of the LED-triple to Vd, 2Vd, and 3Vd. However, as the number of LEDs 2 increases, the complexity of the control circuit driving the LEDs within the module increases considerably. Furthermore, the illumination performance of the array is also negatively affected because some LEDs can be driven at currents lower than 33% of the array rated current. The advantages of having arrays with LED-pairs 12 are not anticipated by the prior art in either the written specifications or the drawings.

Since the configuration of the LED shown in FIG. 1 does not change, the LED 2 can be considered static LED. On the other hand, the LEDs forming the LED-pair 12 can be considered dynamic LEDs because they can be reconfigured in series or parallel. For simplicity sake, the embodiments are shown with the switching devices being performed with mechanical switches, however, it is understood that the actual construction will be implemented by using electronic switching devices such as MOSFETs, BJTs, IGBTs, and FETs among other electronic devices capable of implementing the switching function.

Figure 8:
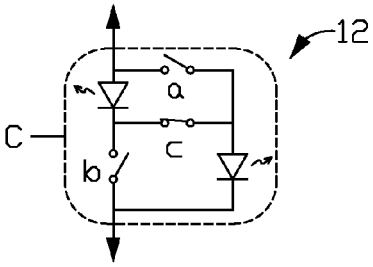
FIG. 8 illustrates an LED-pair with a control line.

The states of the switching devices 'a', 'b', and 'c' of the LED-pair 12 can be changed with a single control line 'C' as illustrated in FIG. 8. This function can be implemented by replacing the mechanical switches (a) and (b) with enhancement mode MOSFETs and switch (c) with a depletion mode MOSFET. In this way the gates of the MOSFETs within an LED-pair 12 can be logically tight together to a single control line. When using a single control line 'C', the default state of the LED-pair 12 is series because the state of the depletion mode MOSFET represented by the switch 'c' is low impedance when no power is applied, while the state of the enhancement mode MOSFETs represented by the switches 'a' and 'b' is high impedance. Then, the LED-pair 12 can be configured in series when the status of the control line 'C' is logic low and configured in parallel when the status of the control line 'C' is logic high. The default state of this LED-pair 12 can also be considered fail safe since the array containing these LED-pairs 12 presents its highest impedance when initially connected to a voltage source, exposing the LEDs within the array to the minimum current when the control lines are not yet stable due to initialization delays within the control circuit.

Figure 9:
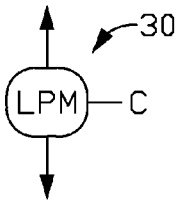
FIG. 9 illustrates the LED-pair shown in FIG. 8 integrated in a single module.
Figure 13:
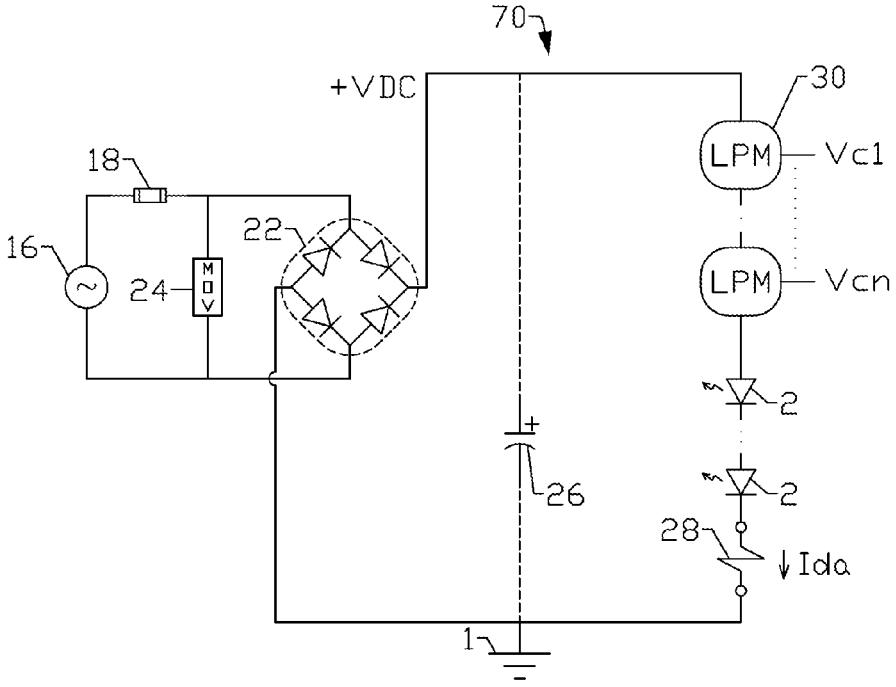
FIG. 13 illustrates a solid state lighting fixture powered from an AC voltage source with an array having some of the LED modules shown in FIG. 9.

The LED-pair 12 shown in FIG. 8 can be integrated in a single LED-pair module 30 shown in FIG. 9. Module 30 can ease the implementation of the solid state lighting fixtures 70 based on LED-pairs 12 as illustrated in FIG. 13. The AC voltage source 16 is converted to a full wave DC voltage by the bridge rectifier 22. The fuse 18 can protect the fixture 70 against current overloads while the metal oxide varistor 24 can protect against momentary line over voltages. A capacitor 26 can be added to minimize the AC ripples of the voltage +VDC. The array shown in fixture 70 comprises dynamic LEDs represented by the LED-pair modules 30 and static LEDs 2 connected in series. A shunt resistor 28 can be added to monitor and control the current Ida flowing through the array.

Figure 14:
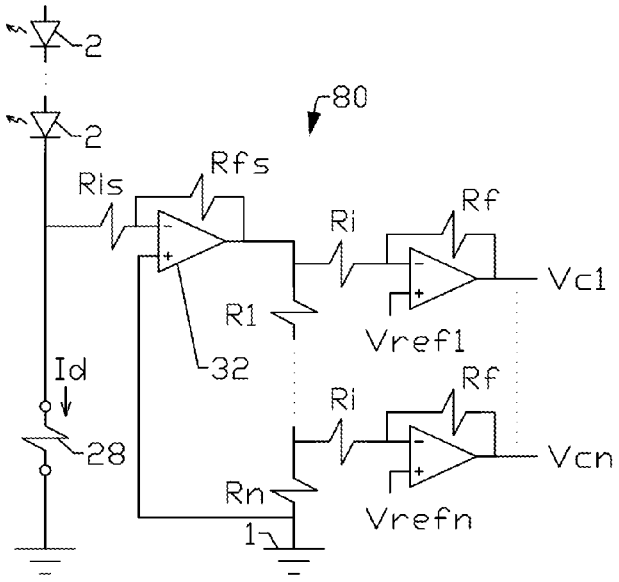
FIG. 14 illustrates a control circuit based on analog devices.
Figure 15:
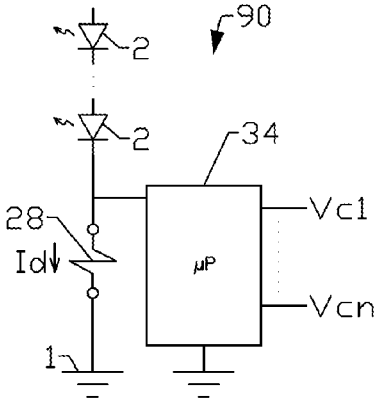
FIG. 15 depicts a control circuit based on a microprocessor unit.

FIG. 14 and FIG. 15 illustrate two possible implementations of the control circuits used to change the states of the modules 30 forming the LED array of the lighting fixture 70 shown in FIG. 13. The analog control circuit 80 shown in FIG. 14 can be implemented with operational amplifiers 32 or other types of analog electronic devices. The changes of the array current Ida can be amplified and used to activate the control lines Vc1 through Vcn. A microprocessor version of the control circuit 90 is shown in FIG. 15. The microprocessor unit 34 can read the changes of the array current Ida and activate the control lines Vc1 though Vcn in accordance with the software algorithm stored in the unit 34. The control circuit can also be implemented with other electronic devices, for example, it can be constructed with logic gates only. The control circuits 80 and 90 can also be designed to monitor the array voltage instead of the current or to accept inputs for other important parameters affecting the performance of the LEDs. For instance, the temperature of the LEDs can be factored into the control function to improve the overall performance of the LED lighting fixture 70.

The implementation details of the integrated control circuit 14 and the control circuit driving the LED-pair 12 are not shown for simplicity. It is understood that a person with ordinary skills in the art can design these control circuits when the control specifications are provided.

As an example of the application of the disclosed inventive concept, assume the lighting fixture 70 shown in FIG. 13 is a retrofit that can be screwed into a standard 120 Vac light bulb socket. The 120 Vac represents the Mean Square Root (RMS) value of the voltage source 16. After rectification and filtering, the +VDC value is approximately equal to the peak voltage Vp=√2*120V=169.7 Vdc. The LED used for this example is a neutral white color LED series XLamp XP-G as manufactured by Cree, Inc., with the following electrical characteristics: when the forward rated current Idr=1000 ma, the LED forward voltage Vdr=3.30V, and the illumination is 305 lm (lumens), approximately. When the forward current drops to 50%, Idh=500 ma, the LED forward voltage is Vdh=3.11V, and the illumination level is 162 lm, approximately. If the rated voltage of each LED is Vdr=3.3V, then, the approximate number of LEDs required for the array of the fixture 70 can be estimated as 169.7V/3.3≈170V/3.3≈52. That is, about 52 LEDs connected in series add up to approximately 171.6 Vdc closely matching the magnitude of the voltage source 16. If a total of 58 LEDs were used to construct the array, the number of static and dynamic LEDs can be equal to 30 and 28, respectively. The twenty eight dynamic LEDs are represented by fourteen LED-pair modules 30. Because the fourteen LED-pair modules 30 are initially connected in series, the initial impedance of the array occurs when all 58 LEDs are configured in series, representing the highest possible impedance of the LED array. Therefore, and momentarily, the magnitude of the voltage source 16 rated at 169.7V is smaller than the array rated voltage Vdar, which is approximately equal to Vdar=58×3.3V=191.4V. As a consequence, during the initialization period the LEDs are guaranteed to be driven at a lower current value than their rated value. As the control circuit samples and processes the array current Ida through the shunt resistor 28, it starts activating the control lines and configuring the LED-pair modules 30 in parallel until the array forward current Ida is approximately equal to the array rated current Idar=1000 ma. In this case, when the array rated current Idar flows, the array rated voltage should match the 170V of the source, approximately. Then, the control circuit starts activating the control lines Vc1 through Vc14 to configure seven LED-pair modules 30 in parallel for a new array rated voltage Vdar=30*Vdr+7*Vdh+14*Vdr=30*3.30V+7*3.11V+14*3.30V=166.97V. The voltage difference Vdiff≈169.7−166.97=2.73V can represent the voltage losses distributed among the shunt resistor 28, the switching transistors, and other Joules' losses in the wiring, terminations, etc.

As described above, a change in the configuration of an LED-pair module 30 produces a change in voltage drop equal to Vdr≈3.3V. Then, the control circuit can be set to respond to variations in the input voltage equal to ±Vdr or its equivalent variations in the array current Ida. For instance, if the voltage source 16 is increased by a magnitude Vdr, the control circuit can activate six control lines to configure six LED-pair modules 30 in parallel. The new array rated forward voltage Vdar can be estimated as Vdar=30Vdr+6Vdh+16Vdr=30*3.30V+6*3.11V+16*3.30V=170.46V. On the contrary, if the voltage source 16 is decreased by a magnitude −Vd, the control circuit can reconfigure the array to have eight LED-pairs modules 30 in parallel. The new array rated voltage Vdar can now be estimated as Vdar=30Vdr+8Vdh+12Vdr=30*3.30+8*3.11+12*3.30=163.48V.

The regulation of the above lighting fixture 70 can be estimated as follows, at rated voltage source 16 there are seven modules 30 configured in series and seven configured in parallel for an approximate array rated voltage of Vdar=166.97V, as described above. The array luminosity can be estimated as 30*305+14*162+14*305=15,688 lumens. That is, 44 LEDs are driven at about 1000 ma, while 14 LEDs are driven at about 500 ma. The maximum array rated voltage Vdar=191.4V occurs when all fourteen modules 30 are configured in series. The array maximum luminosity can now be estimated as 58*305=17,790 lumens. That is, all 58 LEDs are driven at the rated current of 1000 ma. The array minimum rated voltage is Vdar=30Vdr+14Vdh=30*3.30V+14*3.11V=142.54V, which occurs when all fourteen modules 30 are configured in parallel. That is, 30 LEDs are driven at 1000 ma while 28 LEDs are driven at 500 ma. The array minimum luminosity can be estimated as 30*305+28*162=13,686 lumens. The luminosity tolerance corresponding to the maximum allowable change of the line voltage is equal to (17,790−13,686)/2=±2,052 lumens. And, the percentage regulation can be estimated approximately as (±2,052/15,688)*100=±13%. The range of the voltage corresponding to the maximum allowable changes of the line voltage can be estimated approximately as 191.4−142.54=48.86V, and the percentage regulation as (48.86V/166.97V)*100=29.3% or ±14.63%. In summary, 14.63% change of the input voltage 16 generates an array luminosity change of about 13%. The lighting regulation is affected by the shape of the LED flux vs current graphs provided by the manufacturers. For instance, calculations based on a 20 ma LED as manufactured by Everlight Electronics, Co., LTD., indicated that an 8% change of the applied voltage resulted in a change of illumination better than 3%. Nevertheless, the percentage change in luminosity is either equal or better than that for an incandescent light bulb.

Even though FIG. 13 shows the lighting fixture 70 constructed of a single LED array with an approximate average power rating of 166.97V*1000 ma≈167 W, the power rating of the lighting fixture 70 can easily be increased to 334 W, 501 W, etc., by simply adding LED arrays in parallel, while the illumination increases to 31,376 lm, 47,064 lm, etc., respectively. In addition, the complexity of the control circuit is not substantially increased because any additional array can share the same control lines Vc1 through Vc14. The LED lighting fixtures 70 can also be designed with dual rated voltages by changing the series-parallel configurations (not shown) among multiple LED arrays. For example, a dual rated LED lighting fixture 70 can be plugged into a 120 Vac standard socket when the LED arrays within the fixture are configured in parallel or to a 277 Vac electrical system when the LED arrays are configured in series. The users, through an external switch, can perform the voltage ratings transition manually. Alternatively, the LED fixture can be furnished with an auto detection circuit (not shown) to automatically adjust to the voltage rating of the electrical system by changing the configuration of the LED arrays within the fixture 70.

Figure 10:
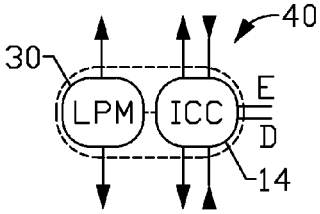
FIG. 10 illustrates the LED-pair module shown in FIG. 9 integrated with some control functions in a single module.

The control circuits shown in FIG. 14 and FIG. 15 can be further simplified if the LED-pair modules 30 are constructed with additional control functions. FIG. 10 illustrates an LED-pair module 40 which includes the integration of the LED-pair 12 and an integrated control circuit 14. The integrated control circuit 14 can read the states of other modules 40 located above and below, and it can also broadcast its state to other modules 40. The control lines 'ED' can be the output of a directional circuit 36 that determines if the array current Ida is outside an allowable range. The control line 'E' is the enable function. When the enable line 'E' is logic '0', for example, the array rated current Ida is within permissible values and the actual configurations of the LED-pairs 12 within the modules 40 do not change. When the array current Ida is outside the allowable range, the enable line is set to logic '1'. Then, the states of the module 40 can change based on the states of the modules 40 located immediately above and below, and the state of the control line 'D'. The control line 'D' can be set to logic '0', for example, when the array current Ida is below the lower limit. And, the control line 'D' can be set to logic '1', when the array current Ida is above the upper limit. The actual state of a module 40 does not change when the states of the upper and lower modules 40 are the same. On the other hand, if the states of the neighbors modules 40 are not equal, the present state of a module 40 can either change to series if the control line 'D' is set to logic '1', or to parallel if the control line 'D' is set to logic '0'.

Figure 16:
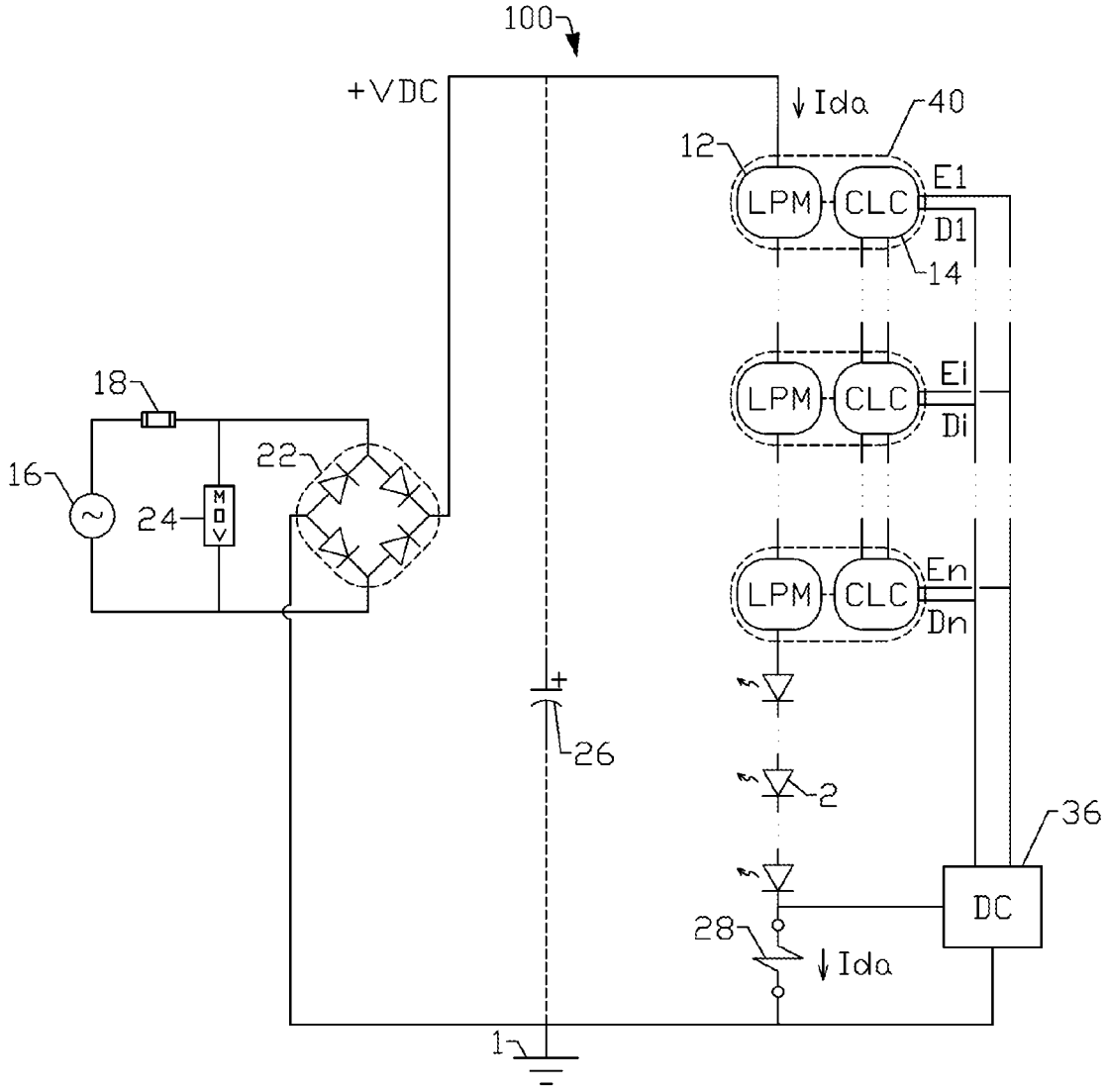
FIG. 16 illustrates the lighting fixture shown in FIG. 13 with the array having some of the LED modules shown in FIG. 10.

FIG. 16 illustrates one embodiment of a solid state lighting fixture 100 with the array having some LED-pair modules 40. As previously indicated, by default, the initial configuration of each LED-pair 12 is in series presenting the array highest possible impedance. After the initialization time delay, the directional circuit 36 detects that the array current Ida is below the permissible lower limit, which sets control lines to the logic states ED=10. The states of the lower modules 40 do not change because their neighbors have equal state. However, the top module 40 changes to parallel because the module 40 below is in series. If the control lines 'ED' remain logic '10', the second module 40 from the top can change to parallel. This process can continue until the enable line 'E' changes to logic '0' when the array current Ida rises to a value in between the upper and lower permissible limits. If the array current Ida increases beyond the upper limit due to an increase in the applied voltage 16, the control lines change to the logic state ED='11', and the states of the modules 40 are sequentially reconfigured in series until the array current Ida falls again within the permissible limits. It should also be noted that the control lines 'E' and 'D' logic functions can also be integrated with the LED-pair modules 40 eliminating the need for a separate directional circuit 36. This new LED module 41 (not shown) can be similar to the LED-pair module 40 shown in FIG. 10 except without the 'E' and 'D' control lines allowing for a driverless solid state lighting fixture (not shown).

Figure 11:
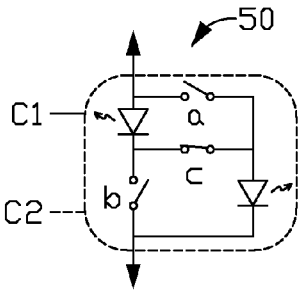
FIG. 11 shows an LED-pair with two control lines.
Figure 12:
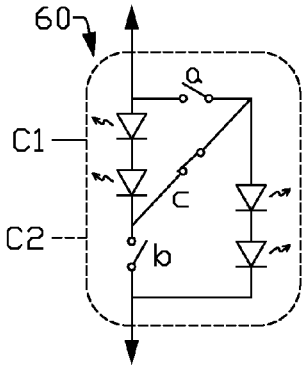
FIG. 12 shows another LED-pair of FIG. 11 having two lamps per branch.

Additional embodiments of the LED-pairs can have more than one control line. FIG. 11 and FIG. 12 illustrate additional embodiments 50 and 60 of the LED-pair 12. These embodiments require two control lines 'C1' and 'C2' to select one of four possible states such as high impedance state (or open circuit), zero impedance state (or short circuit), parallel state, and series state. The parallel and series states are similar to those already described for the LED-pair 12. In high impedance state, all switching devices 'a', 'b', and 'c' are open. In zero impedance state, all switching devices 'a', 'b', and 'c' are closed. In addition, the LED-pair 12 can have more than one LED per branch. FIG. 12 illustrates and embodiment of an LED-pair 60 comprising two LEDs per branch. The current rating of the LED-pair 60 is the same as the LED-pair 12. However, the voltage rating is different. In parallel, the voltage rating of the LED-pair 60 is 2Vd, while in series, the voltage rating is 4Vd.

This written description uses examples to disclose the invention, including the best mode, and also to enable any person skilled in the art to make and use the invention. The patentable scope of the invention is defined by the claims, and may include other embodiments that occur to those skilled in the art. Such other embodiments are intended to be within the scope of the claims if they have structural elements that do not differ from the literal language of the claims, or if they include equivalent structural/functional elements with insubstantial differences from the inventive concept herein claimed.

What is claimed is:

1. An LED array used in general illumination applications, the array comprising:

LED groups, the groups being formed in such a way as to allow a current entering the array to also flow through each of said groups;

each group comprising a plurality of LEDs capable of reconfiguring the interconnections among the LEDs within said plurality; and, the number of groups forming the array being such that said number makes the non-simultaneous reconfigurations of the groups capable of substantially controlling said current flowing through the array.

2. The array of claim 1, wherein at least one of said groups of LEDs is integrated in a module.

3. The array of claim 2, wherein each of said modules further comprises a circuit configured to allow for the interconnection between neighbor modules in such a way as to coordinate the reconfigurations of the LED groups integrated in said neighbor modules.

4. The array of claim 1, wherein at least one of the pluralities comprises a pair of LEDs.

5. The array of claim 1, wherein at least one of the pluralities comprises two branches of LEDs, each branch being formed by a fixed series connection of two or more LEDs, and said plurality comprising a means for reconfiguring the interconnection between the branches.

6. The array of claim 1, wherein each of said groups comprises a circuit configured to allow for the interface between neighbor groups in such a way as to coordinate the changes of the interconnections of the LEDs within said neighbor groups.

7. The array of claim 1, wherein the array is integrated in a module.

8. A solid state lighting fixture used in general illumination applications, the fixture comprising a housing that encloses at least an array, the array comprising:

a first plurality of LEDs, each LED of said first plurality being connected in series with the array;

groups of LEDs, the groups being formed in such a way as to allow a current entering the array to also flows through each of said groups;

each group comprising a second plurality of LEDs and a means for changing the interconnections among the LEDs within said second plurality; and, the number of LEDs of the first and second pluralities being such that the number allows the changes of the interconnections to substantially control said current flowing through the array.

9. The lighting fixture of claim 8, wherein at least one of said groups is integrated in a module.

10. The lighting fixture of claim 9, wherein each of said modules further comprises a circuit configured to allow for the interface between neighbor modules in such a way as to coordinate the changes of the interconnections of the LEDs within the second pluralities integrated in said neighbor modules.

11. The lighting fixture of claim 8, wherein at least one of the second pluralities of said groups comprises a pair of LEDs.

12. The lighting fixture of claim 8, wherein at least one of said second pluralities comprises two branches of LEDs, each branch being formed by two or more LEDs having a fixed series connection, and said second plurality being capable of changing the interconnections between the two branches.

13. The lighting fixture of claim 8, wherein each of said groups comprises a circuit configured to interface neighbor groups in such a way as to coordinate the changes of the interconnections of the LEDs within the neighbor groups.

14. The lighting fixture of claim 8, wherein said fixture comprises two or more arrays.

15. The lighting fixture of claim 14, wherein the arrays comprise a means for reconfiguring the interconnections among said arrays.

16. An LED array used in general illumination applications, the array comprising, a first plurality of LEDs, each LED of said first plurality being connected in series with the array;

groups of LEDs, each group being connected in series with the array;

each group comprising a second plurality of LEDs with a means to reconfigure the interconnections among the LEDs within said second plurality; and, the number of LEDs of the first and second pluralities being such that said number allows the reconfigurations of the LEDs within said second pluralities to substantially control a current flowing through the array.

17. The array of claim 16, wherein at least one of the second pluralities of said groups comprises a pair of LEDs.

18. The array of claim 16, wherein at least one of said second pluralities of the groups comprises two strings of LEDs, each string being formed by two or more LEDs connected in series, and said second plurality includes a means for changing the interconnection between the two strings.

19. The array of claim 16, wherein each of the second pluralities of said groups further comprises a means to allow for the interface between neighbor groups in such a way as to coordinate the reconfigurations of the second pluralities of the neighbor groups.

20. The array of claim 19, wherein at least one of the groups is integrated in a module.

21. The array of claim 16, wherein at least one of the groups is integrated in a module.

22. An LED array used in general illumination applications, the array produced by the steps of:

connecting groups of LEDs in such a way as to allow a current entering the array to also flow through each of said groups;

furnishing each of said groups of LEDs with a means to allow for the reconfiguration of the interconnections among the LEDs of the group; and furnishing the array with a number of groups such that the number makes the non-simultaneous reconfigurations of the groups capable of substantially controlling said current flowing through the array.

* * * * *